US007371995B2

(12) United States Patent
Sugimoto

(10) Patent No.: US 7,371,995 B2
(45) Date of Patent: May 13, 2008

(54) FIXING DEVICE AND IMAGE FORMING APPARATUS

(75) Inventor: Tasuku Sugimoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 91 days.

(21) Appl. No.: 11/477,615

(22) Filed: Jun. 30, 2006

(65) Prior Publication Data

US 2007/0000900 A1 Jan. 4, 2007

(30) Foreign Application Priority Data

Jun. 30, 2005 (JP) ..... 2005-191579
Jun. 26, 2006 (JP) ..... 2006-174938

(51) Int. Cl.
*G03G 15/20* (2006.01)

(52) U.S. Cl. ..... 219/216; 219/494; 399/33; 399/69; 399/334

(58) Field of Classification Search ..... None
See application file for complete search history.

(56) References Cited

U.S. PATENT DOCUMENTS 5,555,075 A * 9/1996 Fukano et al. ..... 219/216
6,097,904 A * 8/2000 Tsuruno et al. ..... 219/494
6,965,741 B2 11/2005 Senda
2007/0036572 A1* 2/2007 Ide et al. ..... 399/69
2007/0059009 A1* 3/2007 Nakayama ..... 399/69

FOREIGN PATENT DOCUMENTS

| | | |
|---|---|---|
| JP | 4329574 | 11/1992 |
| JP | 5006126 | 1/1993 |
| JP | 8248812 | 9/1996 |
| JP | 11133796 | 5/1999 |
| JP | 11194660 | 7/1999 |
| JP | 2001-008358 A * | 1/2001 |
| JP | 2003-287976 | 10/2003 |
| JP | 2004-126190 | 4/2004 |

* cited by examiner

*Primary Examiner*—J. Pelham
(74) *Attorney, Agent, or Firm*—Banner & Witcoff, Ltd.

(57) ABSTRACT

A fixing device includes: a fixing roller; a center temperature detection unit including a protective member, the center temperature detection unit contacts the fixing roller in an axial center of the fixing roller and detects a temperature of the center section; an end temperature detection unit that contacts the fixing roller at an end portion of the fixing roller outside of a maximum print area of the recording medium and detects a temperature of the end section; and a control unit that controls heating of the fixing roller performed by the heating unit so that the heating is stopped when the value detected by the center temperature detection unit has exceeded a first upper limit value and when the value detected by the end temperature detection unit has exceeded a second upper limit value, the first upper limit value being lower than the second upper limit value.

16 Claims, 9 Drawing Sheets

FIXING DEVICE AND IMAGE FORMING APPARATUS

CROSS-REFERENCE TO THE RELATED APPLICATION(S)

This application is based upon and claims a priority from prior Japanese Patent Applications No. 2005-191579 filed on Jun. 30, 2005, and No. 2006-174938 filed on Jun. 26, 2006, the entire contents of which are incorporated herein by reference.

TECHNICAL FIELD

Aspects of the present invention relate to a fixing device incorporated into a laser printer, or the like, as well as to an image forming apparatus such as a laser printer.

BACKGROUND

In order to thermally fix a toner image transferred onto sheet, an image forming apparatus, such as a laser printer, is usually equipped with a fixing device having a heating roller and a press roller. During a period in which a sheet passes between the heating roller and the press roller, a toner image transferred on the sheet is thermally fixed.

As shown in FIG. 9, a heating roller 100 of the fixing device usually assumes a cylindrical shape and has a length responsive to the width of a sheet of the maximum size so that a sheet of the maximum size allowed by the image forming apparatus can be subjected to thermal fixing. One heater, formed from a halogen lamp B, is accommodated in the heating roller 100 in the axial direction thereof and over essentially the entire length thereof. The heating roller 100 is heated over essentially the entire length thereof in the axial direction.

In order to determine an anomaly in the temperature of the heating roller 100, a temperature detection unit 101, which utilizes a temperature detecting element, is provided on the surface of the center in the heating roller 100 in a noncontact manner.

However, when a small-size sheet 102*a* (of e.g., A6-size) and a large-size sheet 102*b* (of, e.g., A4-size) are subjected to thermal fixing by use of a single fixing device, the heating roller 100 is usually heated, by the heater, over essentially the entire axial length thereof corresponding to a width of the large-size sheet 102*a*. When the small-size sheet 102*a* is being subjected to thermal fixing, the sheet 102*a* draws heat from the surface of an area of the heating roller 100, which remains in contact with the small-size sheet 102*a*. A control unit 103 performs temperature control such that the temperature of the area, where the small-size sheet 102*a* contacts, is maintained within a given range. Therefore, the other area of the heating roller 100 where the small-size sheet 102*a* does not contact; i.e., an area of the heating roller 100 outside both ends of the small-size sheet 102*a* in the widthwise direction thereof, becomes higher in surface temperature than the center of the heating roller 100 in the widthwise direction thereof.

However, when the large-size sheet 102*b* is subjected to thermal fixing, the higher-temperature area (i.e., the area of the heating roller 100 outside both widthwise ends of the area where the small-size sheet 102*a* has contacted) contacts the large-size sheet 102*b*. When that area has been excessively heated, there arises a hot offset resulting from excessive fixing of toner (i.e., an offset caused as a result of excessively-fused toner adhering to the surface of the heating roller 100).

Even if the surface temperature of the areas of the heating roller 100 outside both widthwise ends of the small-size sheet 102*a* has become higher than the center surface temperature of the heating roller 100 when the small-size sheet 102*a* is thermally fixed, the control unit 103 fails to determine occurrence of an "anomaly," sometimes resulting in fusing of the heating roller 100 or breakage of the fixing device. If the temperature of the heating roller 100 has risen excessively or the fixing device has become broken, high risks are posed to the user.

To prevent this problem, a conceivable method is to place a temperature detection unit at both axial ends of the heating roller in addition to disposing the temperature detection unit in the axial center of the heating roller and to detect the temperature of the heating roller by two temperature detection units.

For instance, there is described a technique pertaining to a fixing device including: a noncontact temperature detection unit provided on a heating roller in a noncontact manner within a sheet image formation area; a contact temperature detection unit provided on the heating roller in a contacted manner within a sheet non-image formation area; and a control unit for stopping supply of power to a heater when status determination unit for detecting a detected status of the noncontact temperature detection unit has determined occurrence of an anomaly in a temperature status. An anomaly is detected by the noncontact temperature detection unit on the basis of a temperature value of the heating roller detected by the noncontact temperature detection unit and a temperature value of the heating roller detected by the contact temperature detection unit (see JP-A-2004-126190).

By the technique such as that described in connection with JP-A-2004-126190, the detection status of the noncontact temperature detection unit can be rationally determined on the basis of the temperature values of the heating roller detected by the two temperature detection units. Occurrence of a problem, which would otherwise be attributed to an anomaly in the detection status of the noncontact temperature detection unit, can be prevented, and hence reliability can be enhanced.

SUMMARY

The noncontact temperature detection unit is more expensive and less stable than a contact temperature detection unit. As in the case of JP-A-2004-126190, using a noncontact temperature detection unit is not suitable in a case where an anomaly in the heater is detected as well as a case where an anomaly in the detection status of the noncontact temperature detection unit. However, if the temperature detection unit provided opposite the surface of the heating roller in the image formation area is embodied by a contact temperature detection unit, toner adheres to a detection portion of the temperature detection unit, thus hindering detection of a temperature. Alternatively, flaws arise in the surface of the heating roller because of friction between the heating roller and the temperature detection unit, thereby causing streaks in an image.

Aspects of the present invention provide a fixing device and an image forming apparatus, which enables appropriate detection of an anomaly in a heater even when an inexpensive temperature detection unit having superior stability is used.

According to an aspect of the invention, there is provided a fixing device including: a fixing roller that is heated by a heating unit to fix a developer image on a supplied recording medium; a center temperature detection unit including a protective member that protects the center temperature detection unit, the center temperature detection unit contacts the fixing roller in an axial center of the fixing roller and detects a temperature of the center section; an end temperature detection unit that contacts the fixing roller at an end portion of the fixing roller outside of a maximum print area of the recording medium and detects a temperature of the end section; and a control unit that controls heating of the fixing roller performed by the heating unit so that the heating is stopped when the value detected by the center temperature detection unit has exceeded a first upper limit value, and the heating is stopped when the value detected by the end temperature detection unit has exceeded a second upper limit value, the first upper limit value being lower than the second upper limit value.

According to another aspect of the invention, there is provided an image forming apparatus including: an image forming unit that transferees a developer image; and a fixing device including: a fixing roller that is heated by a heating unit to fix the developer image on a supplied recording medium; a center temperature detection unit including a protective member that protects the center temperature detection unit, the center temperature detection unit contacts the fixing roller in an axial center of the fixing roller and detects a temperature of the center section; an end temperature detection unit that contacts the fixing roller at an end portion of the fixing roller outside of a maximum print area of the recording medium and detects a temperature of the end section; and a control unit that controls heating of the fixing roller performed by the heating unit so that the heating is stopped when the value detected by the center temperature detection unit has exceeded a first upper limit value, and the heating is stopped when the value detected by the end temperature detection unit has exceeded a second upper limit value, the first upper limit value being lower than the second upper limit value.

According to the above aspects, a contact temperature detection unit can be used even for the center temperature detection unit. Hence, the temperature detection unit is inexpensive and exhibits superior stability. Further, the center temperature detection unit is protected by the protective member. Even when the center temperature detection unit is brought into contact with the center of the heating roller within the image forming area, the developer does not adhere to a detection section. Consequently, deterioration of temperature detection performance of the temperature detection unit, which would otherwise be caused by adhesion of the developer, can be prevented. Even when the response speed is made slower as a result of the center temperature detection unit being protected by the protective member, an anomaly can be accurately detected because the first upper limit value is set so as to become lower than the second upper limit value.

According to another aspect of the invention, there is provided a fixing device including: a fixing roller that is heated by a heating unit to fix a developer image on a supplied recording medium; a center temperature detection unit including a protective member that protects the center temperature detection unit, the center temperature detection unit contacts the fixing roller in an axial center of the fixing roller and detects a temperature of the center section; an end temperature detection unit that contacts the fixing roller at an end portion of the fixing roller outside of a maximum print area of the recording medium and detects a temperature of the end section; and a control unit that controls heating of the fixing roller performed by the heating unit so that the heating is stopped when the value detected by the center temperature detection unit has exceeded a first upper limit value, and the heating is stopped when the value detected by the end temperature detection unit has exceeded a second upper limit value, wherein a cycle at that the center temperature detection unit detects the temperature of the center section is set so as to become shorter than a cycle at which the end temperature detection unit detects the temperature of the end portion.

According to another aspect of the invention, there is provided an image forming apparatus including: an image forming unit that transferees a developer image; and a fixing device including: a fixing roller that is heated by a heating unit to fix the developer image on a supplied recording medium; a center temperature detection unit including a protective member that protects the center temperature detection unit, the center temperature detection unit contacts the fixing roller in an axial center of the fixing roller and detects a temperature of the center section; an end temperature detection unit that contacts the fixing roller at an end portion of the fixing roller outside of a maximum print area of the recording medium and detects a temperature of the end section; and a control unit that controls heating of the fixing roller performed by the heating unit so that the heating is stopped when the value detected by the center temperature detection unit has exceeded a first upper limit value, and the heating is stopped when the value detected by the end temperature detection unit has exceeded a second upper limit value, wherein a cycle at that the center temperature detection unit detects the temperature of the center section is set so as to become shorter than a cycle at which the end temperature detection unit detects the temperature of the end portion.

According to the above aspects, a contact temperature detection unit can be used even for the center temperature detection unit. Hence, the temperature detection unit is inexpensive and exhibits superior stability. Further, the center temperature detection unit is protected by the protective member. Even when the center temperature detection unit is brought into contact with the center of the heating roller within the image forming area, the developer does not adhere to a detection section. Consequently, deterioration of temperature detection performance of the temperature detection unit, which would otherwise be caused by adhesion of the developer, can be prevented. Even when the response speed is made slower as a result of the center temperature detection unit being protected by the protective member, an anomaly can be accurately detected, because the cycle at which the center temperature detection unit detects the temperature of the center section is set so as to become shorter than the cycle at which the end temperature detection unit detects the temperature of an end portion.

BRIEF DESCRIPTION OF THE DRAWINGS

These and other objects and advantages of the present invention will be more fully apparent from the following detailed description taken in conjunction with the accompanying drawings, in which.

DETAILED DESCRIPTION OF THE ILLUSTRATIVE ASPECTS

First Aspect

Figure 1:
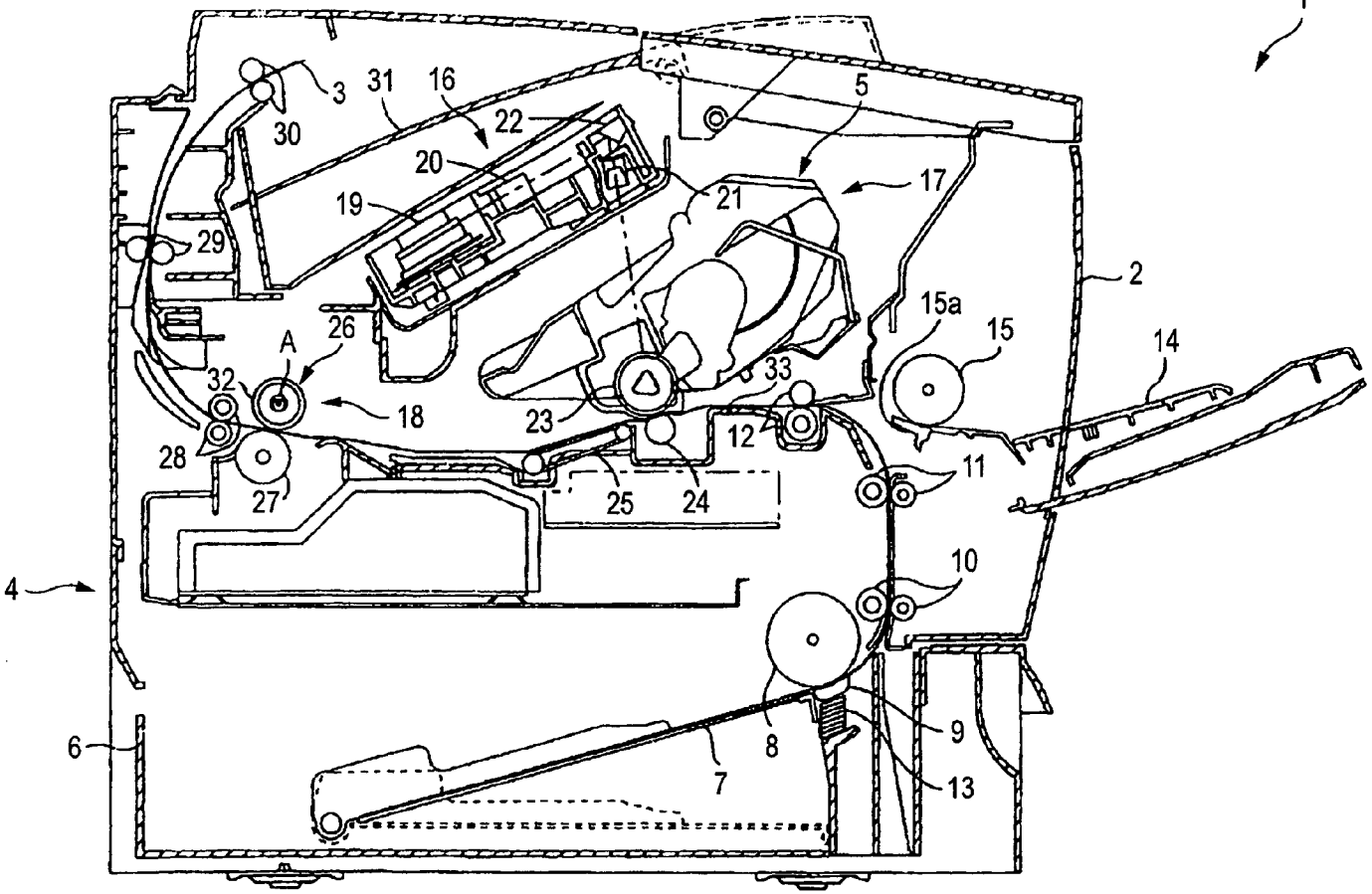
FIG. 1 is a side cross sectional view of the principal section showing one aspect of a laser printer 1.
Figure 2:
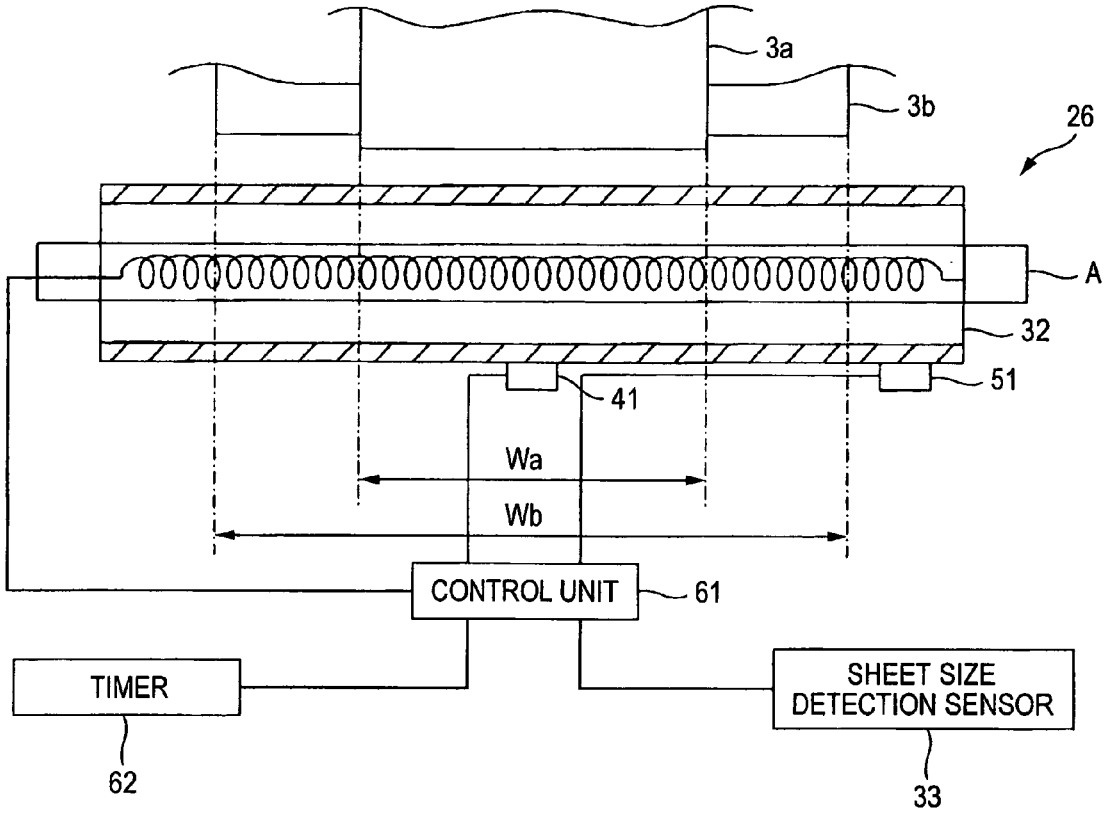
FIG. 2 is a front cross sectional view of the principal section of a heating roller 26 used in a fixing device 18.

The overall configuration of a laser printer, which serves as a fixing device and an image forming apparatus of the present invention, will first be described by reference to FIGS. 1 and 2. FIG. 1 is a side cross sectional view of the principal section showing an aspect of the laser printer 1. FIG. 2 is a front cross sectional view of the principal section of a heating roller 26 used in a fixing device 18. The laser printer 1 has a feeder section 4 for feeding a sheet 3, which serves as a recording medium, provided in a main body casing 2; an image forming section 5 for forming an image on the thus fed sheet 3, and the like.

The feeder section 4 has a sheet feeding tray 6 removably attached to a bottom section within the main body casing 2; a sheet press plate 7 provided within the sheet feeding tray 6; a sheet feeding roller 8 and a sheet feeding pad 9, which are provided at positions above one end of the sheet feeding tray 6; transport rollers 10 and 11 disposed downstream of the sheet feeding roller 8 with respect to the sheet feeding roller 8 in the transport direction of the sheet 3 (the upstream or downstream position with reference to the transport direction of the sheet 3 is sometimes simply called an upstream or downstream position); and a registration roller 12 disposed downstream of the transport rollers 10 and 11 with respect to the transport direction of the sheet 3.

The sheet press plate 7 enables layered stacking of the sheets 3, is supported in a swayable manner at a distal end thereof with respect to the sheet feeding roller 8, is movable at a proximal end thereof so as to be vertically movable, and is upwardly impelled from the back thereof by an unillustrated spring. Therefore, as the amount of stacked sheets 3 increases, the sheet press plate 7 is downwardly swayed in defiance of restoration force of the spring while taking its end distant from the sheet feeding roller 8 as a fulcrum. The sheet feeding roller 8 and the sheet feeding pad 9 are arranged opposite each other, and the sheet feeding pad 9 is pressed toward the sheet feeding roller 8 by a spring 13 provided on the back of the sheet feeding pad 9. The top of the sheets 3 placed on the sheet press plate 7 is pressed toward the sheet feeding roller 8 by an unillustrated spring from the back of the sheet press plate 7. After having been nipped between the sheet feeding roller 8 and the sheet feeding pad 9 by rotation of the sheet feeding roller 8, the sheets are fed one at a time. The thus fed sheet 3 is sent to the registration roller 12 by the transport rollers 10 and 11. The registration roller 12 is formed from a pair of rollers and is arranged to deliver the sheet 3 to an image forming position after having subjected the sheet 3 to predetermined registration. The image forming position is a transfer position where a toner image on a photosensitive drum 23 is transferred to the sheet 3. In the present aspect, the transfer position is a location where the photosensitive drum 23 contacts a transfer roller 24.

The feeder section 4 further includes a multipurpose tray 14, a multipurpose sheet feeding roller 15 and a multipurpose sheet feeding pad 15*a*. The multipurpose sheet feeding roller 15 and a multipurpose sheet feeding pad 15*a* are used for feeding the sheets 3 stacked on the multipurpose tray 14. The multipurpose sheet feeding roller 15 and the multipurpose sheet feeding pad 15*a* are disposed opposite each other. By an unillustrated spring provided on the back of the multipurpose sheet feeding pad 15*a*, the multipurpose sheet feeding pad 15*a* is pressed toward the multipurpose sheet feeding roller 15. By rotation of the multipurpose sheet feeding roller 15, the sheets 3 stacked on the multipurpose tray 14 are fed one at a time after having been nipped between the multipurpose sheet feeding roller 15 and the multipurpose sheet feeding pad 15*a*.

A sheet size detection sensor 33 is provided in the path for transporting the sheet 3 from the registration roller 12 to the transfer position. The sheet size detection sensor 33 relates to control operation for detecting an anomaly in a fixing temperature of the fixing device 18. The sheet size detection sensor 33 detects the size of the sheet 3.

The image forming section 5 has a scanner unit 16, a process cartridge 17, the transfer roller 24, and the fixing device 18.

The scanner unit 16 is provided in an upper part within the main body casing 2 and has a laser emitting section (not shown), a polygon mirror 19 to be rotationally driven, lenses 20 and 21, and a reflection mirror 22. As indicated by a chain line, a laser beam, which is emitted from the laser light emitting section and is based on image data, is caused to sequentially pass through or undergo reflection on the polygon mirror 19, the lens 20, the reflection mirror 22, and the lens 21, to thus effect radiation and scanning of the laser beam over the surface of the photosensitive drum 23 of the process cartridge 17 to be described later at high speed.

The process cartridge 17 is disposed beneath the scanner unit 16 and is removably attached to the main body casing 2. The process cartridge 17 has the photosensitive drum 23, as well as having a scorotron electrifying device, a development roller, and a toner storage section, which are not shown.

The toner storage section is filled with, as a developer, nonmagnetic one component polymeric toner having a positive charging characteristic, and the toner is spread over the development roller as a thin layer of given thickness.

The photosensitive drum 23 is rotatably provided opposite the development roller, and the drum main body is grounded. The surface of the photosensitive drum 23 is formed from a photosensitive layer of positive charging characteristic, which is made of polycarbonate or the like.

The transfer roller 24 is disposed opposite the photosensitive drum 23 while being rotatably supported by the main body casing 2 at a position below the photosensitive drum 23. The transfer roller 24 is formed by protecting a metal roller shaft with a roller made of a conductive rubber material. A predetermined transfer bias is applied to the photosensitive drum 23.

The fixing device 18 has a heating roller 26, a press roller 27 and a transport roller 28. The heating roller 26 is disposed at a laterally downstream position with respect to the process cartridge 17 and acts as a fixing roller. The press roller 27 is disposed opposite the heating roller 26 with the transport path for the sheet 3 interposed therebetween and presses the heating roller 26. The transport roller 28 is disposed downstream of the heating roller 26 and the press roller 27. The fixing device 18 is mounted in the laser printer 1 in an insertable manner.

The heating roller 26 has a roller main body 32 and one halogen lamp A. The roller main body 32 is made from aluminum and acts as a cylindrical heating member. The halogen lamp A acts as a heating unit. As shown in FIG. 2, the halogen lamp A is provided in the roller main body 32 along the axial direction thereof. The roller main body 32 is heated by the halogen lamp A. The temperature of the axial center of the heating roller 26 is periodically detected by a center thermistor 41 serving as a center temperature detection unit to be described later, and the temperature of the axial ends of the heating roller 26 is periodically detected by an end thermistor 51, which serves as an end temperature detection unit to be described later. On the basis of the detected temperature, a control unit 61, which will be described later, appropriately activates/deactivates the halogen lamp A according to the detected temperature, to thus control a temperature.

As shown in FIG. 1, the press roller 27 is formed by coating a metal roller shaft with a roller made of an elastic body. The press roller 27 presses the heating roller 26 at a predetermined pressure. The fixing device 18 thermally fixes the toner image, which has been transferred on the sheet 3 by the process cartridge 17, during the course of the sheet 3 passing between the heating roller 26 and the press roller 27.

Figure 3:
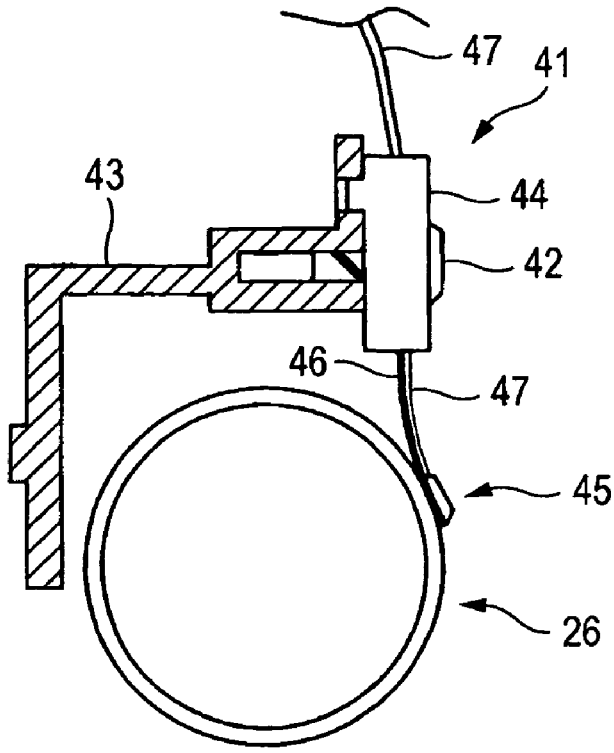
FIG. 3 is a cross sectional view of a heating roller 26 and that of a center thermistor 41, both of which are acquired in an axial center of the heating roller 26.
Figure 4A:
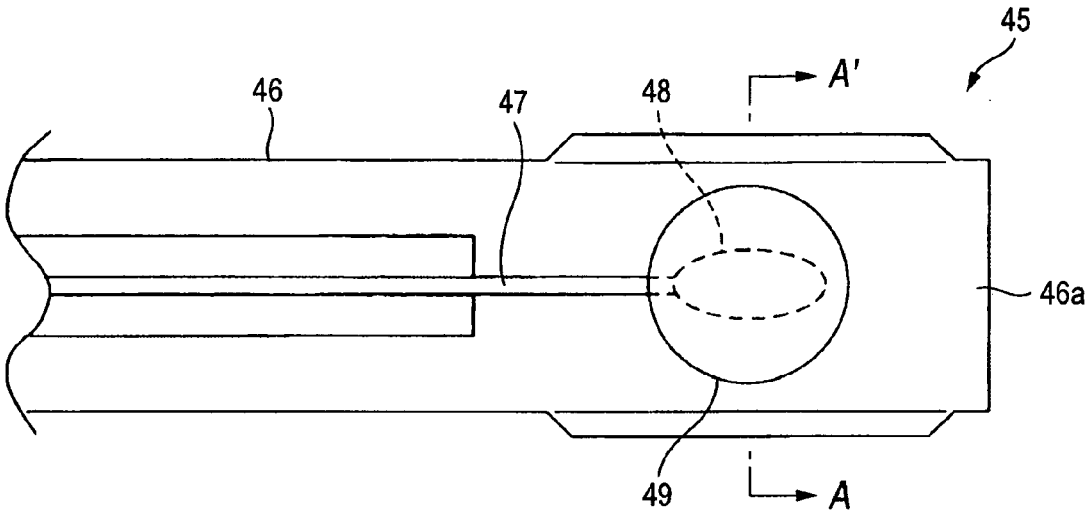
FIG. 4A is an enlarged plan view of a neighborhood of a temperature detection section 45 constituting the center thermistor 41.
Figure 4B:
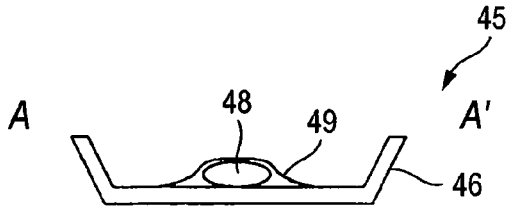
FIG. 4B is a cross sectional view of a neighborhood of a temperature detection section 45, constituting the center thermistor 41, which is taken along line A-A' in FIG. 4A.
Figure 5:
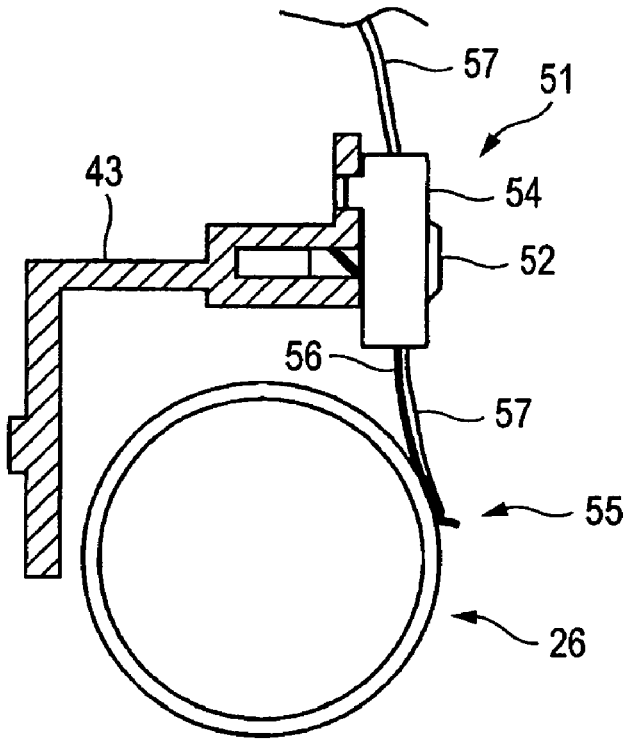
FIG. 5 is a cross sectional view of the heating roller 26 and that of an end thermistor 51, both of which are taken at an axial end of the heating roller 26.
Figure 6A:
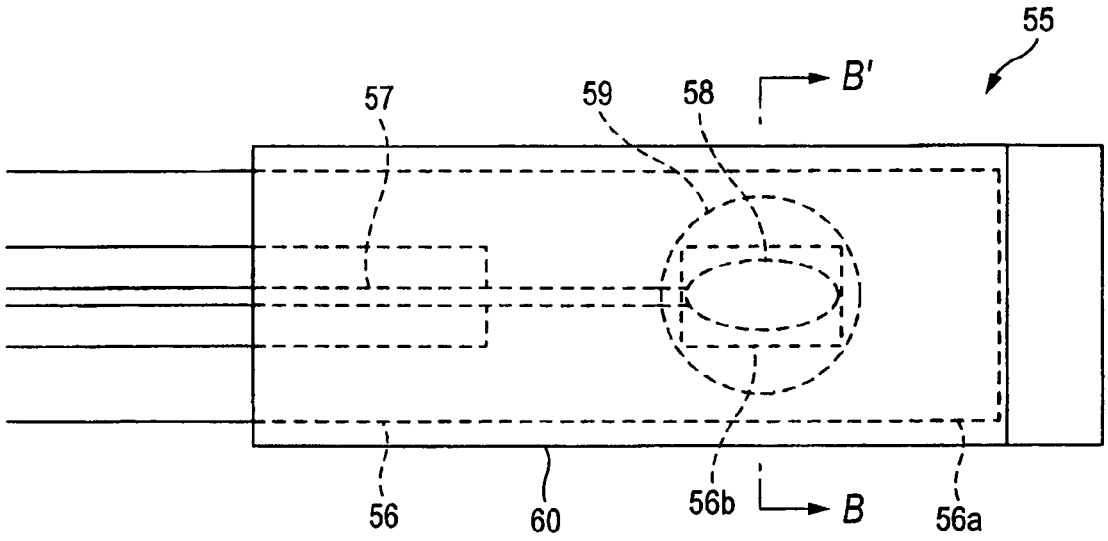
FIG. 6A is an enlarged plan view of a neighborhood of a temperature detection section 55 constituting the end thermistor 51.
Figure 6B:
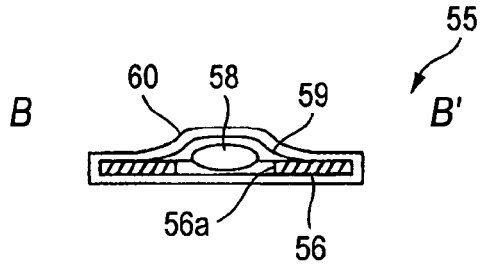
FIG. 6B is a cross sectional view of the neighborhood of the temperature detection section 55 constituting the end thermistor 51 taken along line B-B' in FIG. 6A.

Next, a configuration for controlling the heating temperature of the heating roller 26 will be described as the configuration of the principal section of the present invention, by reference to FIGS. 2 through 6. FIG. 3 is a cross sectional view of the heating roller 26 and the center thermistor 41, which are located in the axial center of the heating roller 26. FIG. 4A is an enlarged plan view of a temperature detection section 45 constituting the center thermistor 41. FIG. 4B is a cross sectional view of the temperature detection section 45 constituting the center thermistor 41, taken along line A-A' in FIG. 4A. FIG. 5 is a cross sectional view of the heating roller 26 and that of the end thermistor 51, which are acquired at the axial end of the heating roller 26. FIG. 6A is an enlarged plan view of a temperature detection section 55 constituting the end thermistor 51. FIG. 6B is a cross sectional view of the temperature detection section 55 constituting the end thermistor 51, as taken along line B-B' in FIG. 6A.

As shown in FIGS. 3, 4A and 4B, the center thermistor 41 includes a main body section 44, a metal plate 46, the temperature detection section 45 and a lead wire 47. The main body section 44 is secured to a support member 43, which serves as a frame body of the fixing device 18, by screws 42. The metal plate 46 acts as a protective member, which contacts the roller main body 32 of the heating roller 26 attached to the main body section 44 and is plated with tin. The temperature detection section 45 is mounted on the metal plate 46 and detects the surface temperature of the axial center portions of the heating roller 26. The lead wire 47 is used for transmitting the temperature value, which has been detected by the temperature detection section 45, to the control unit 61. The center thermistor 41 is inexpensive and has superior stability. The temperature detection section 45 includes a thermistor element 48 and a resin cover 49. The thermistor element 48 is provided at a lead end section 46*a* of the metal plate 46 and is connected to the lead wire 47. The thermistor element 48 detects the temperature of the axial center of the heating roller 26. The resin cover 49 covers the thermistor element 48. The resin cover 49 is mounted on the leading end 46*a* of the metal plate 46. The resin cover 49 is formed from resin such as fluororesin or epoxy resin. In order to prevent deterioration in temperature detection performance, which would otherwise be caused when the toner having adhered to the heating roller 26 during thermal fixing operation adheres to the thermistor element 48, as well as to make the metal plate 46 resistant to abrasion which arises when the metal plate slidably contacts the surface of the heating roller 26, the metal plate 46 protects the thermistor element 48 and is formed to a thickness of about 0.5 mm. In this aspect, the metal plate 46 is formed of a copper. However, the metal plate 46 may be formed of other metals such as a stainless steel or phosphor bronze.

As shown in FIG. 2, by the configuration, the center thermistor 41 is provided while remaining in contact with the metal plate 46 in the vicinity of a location where the temperature detection section 45 is located at the axial center on the surface of the heating roller 26; periodically detects the temperature of the axial center of the heating roller 26; and transmits a detected value to the control unit 61. On the basis of the detection value received from the center thermistor 41, the control unit 61 monitors whether or not the temperature of the heating roller 26 shows an anomalous value, by a control to be described later.

As shown in FIG. 5 and FIGS. 6A and 6B, the end thermistor 51 includes a main body section 54, a metal plate 56, the temperature detection section 55 and a lead wire 57. The main body section 54 is secured to the support member 43 by a screw 52. The support member 43 is a frame body of the fixing device 18. The metal plate 56 is mounted to the main body section 54 and extends toward the heating roller 26. The metal plate 56 is plated with tin. The temperature detection section 55 is mounted to the metal plate 56 and contacts the roller main body 32 of the heating roller 26. The lead wire 57 for transmitting the temperature value is detected by the temperature detection section 55 to the control unit 61. In this aspect, the metal plate 56 is formed of a copper. However, the metal plate 56 may be formed of other metals such as a stainless steel or phosphor bronze. The end thermistor 51 configured as mentioned above is inexpensive and has superior stability. The temperature detection section 55 includes a thermistor element 58, a resin cover 59 and a resin tape 60. The thermistor element 58 is provided at a leading end portion 56*a* of the metal plate 56, is connected to the lead wire 57, and detects the temperature of an axial end portion of the heating roller 26. The resin cover 59 coats the thermistor element 58, is mounted at the leading end portion 56*a* of the metal plate 56 and is formed from resin such as fluororesin or epoxy resin.

The resin tape 60 coats the thermistor element 58, the resin cover 59 and the leading end portion 56*a* of the metal plate 56 so as to protect the surface of the heating roller 26 from damage. The resin tape 60 has a thickness of about 0.1 mm and high thermal conductivity. A detection hole 56*b*, which is greater in size than the thermistor element 48, is formed in the metal plate 56. The thermistor element 48 is fixed by the resin cover 59 so as to be surrounded by the detection hole 56*b*. Occurrence of a delay in a speed at which the thermistor element 58 detects the temperature of the axial end portions of the heating roller 26 can be prevented. Namely, occurrence of a delay in the response speed of the thermistor element 48, which would otherwise be caused by a hindrance imposed by the leading end portion 56*a*, can be prevented.

As shown in FIG. 2, in the above configuration, the end thermistor 51 is disposed, in a contacting manner, on the resin tape 60 of the temperature detection section 55, at one of the axial ends of the heating roller 26 and a position on the surface of the heating roller 26 outside the widthwise ends of the largest sheet 3*b* that can be fixed by the fixing device 18. The end thermistor 51 periodically detects the temperature of the axial end of the heating roller 26, and transmits the thus detected value to the control unit 61. On the basis of the detection value received from the end thermistor 51, the control unit 61 monitors whether or not the temperature of the heating roller 26 shows an anomalous value, by control operation to be described later.

Printing operation of the laser printer 1 of the present aspect, such as that described above, will now be described by reference to FIG. 1.

After having been nipped by the sheet feeding roller 8 and the sheet feeding pad 9 by rotation of the sheet feeding roller 8, the sheet 3, which is fed one at a time, is sent to the registration roller 12 by the transfer rollers 10 and 11. After having subjected the sheet 3 to predetermined registration, the registration roller 12 sends the sheet 3 to the image forming position. In the meantime, the sheets 3 stacked on the multipurpose tray 14 are fed one at a time after having been nipped by the multipurpose sheet feeding roller 15 and the multipurpose sheet feeding pad 15*a* by rotation of the multipurpose sheet feeding roller 15.

After having been uniformly, positively electrified by the scorotron electrifying device in association with rotation of the photosensitive drum 23, the surface of the photosensitive drum 23 is exposed by high speed scanning of the laser beam emitted from the scanner unit 16, whereby an electrostatic latent image is formed from image data. Subsequently, when opposing the development roller, the positively charged toner carried on the development roller is supplied to the electrostatic latent image formed on the surface of the photosensitive drum 23. Namely, the toner is supplied to an area, whose potential has been lowered when exposed to the laser beam, on the uniformly, positively charged surface of the photosensitive drum 23, and the toner is selectively carried, to thus render the latent image visible. Thus, negative development is achieved. The visible image, which is formed from the toner image and carried on the photosensitive drum 23, is transferred to the sheet 3 during the course of the sheet 3 passing through the image forming position between the photosensitive drum 23 and the transfer roller 24. The sheet 3 on which the visible image is transferred is transported to the fixing device 18 by way of a transfer belt 25. The sheet 3 fixed by the fixing device 18 is subsequently transported to the transport roller 28 disposed downstream of the fixing device 18, as well as to a transport roller 29 and a sheet output roller 30, which are disposed downstream of the transport roller 28. The sheet is output to a sheet output tray 31 by the sheet output roller 30.

Figure 7:
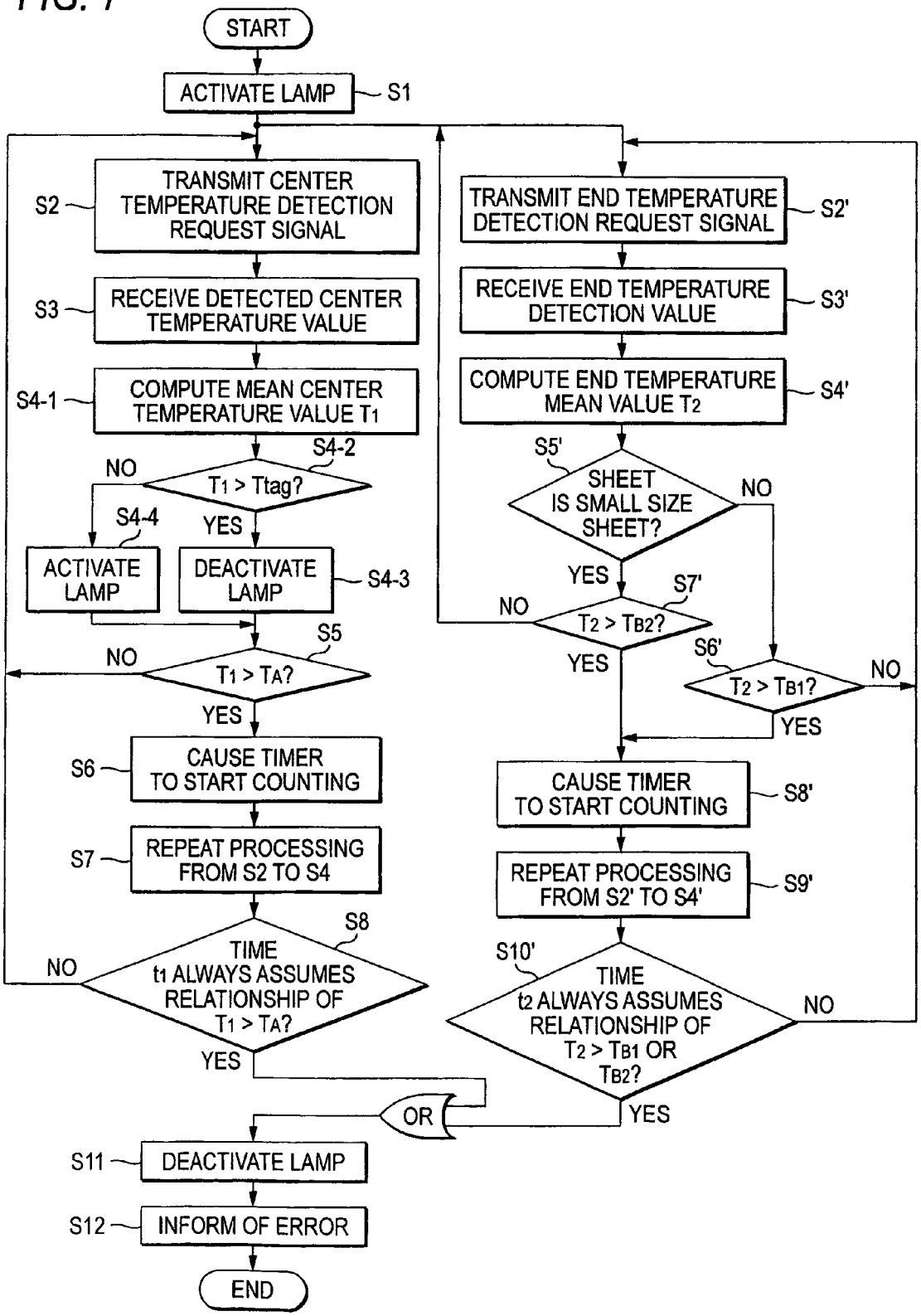
FIG. 7 is a flowchart showing control operation of the control unit 61 employed when an anomaly in the temperature of a halogen lamp A of the heating roller 26 according to a first aspect is detected.

Control for detecting an anomaly in the heating temperature of the heating roller 26 by the control unit 61 is described as control of the principal section of the present invention by reference to FIG. 7. FIG. 7 is a flowchart showing control operation of the control unit 61 performed upon detection of an anomaly in the temperature of the halogen lamp A of the heating roller 26 of the present aspect.

First, power of the laser printer 1 is turned on, and the control unit 61 activates the halogen lamp of the heating roller 26 (S1). A temperature detection request signal is transmitted several times to the center thermistor 41 at a sampling cycle of 20 msec (S2). The center thermistor 41 detects the temperature of the center of the heating roller 26 in the widthwise direction thereof at the sampling cycle of 20 msec. A plurality of temperature detected values are sent to the control unit 61 (S3). The control unit 61 computes a mean value $T_1$ of the center temperature from 10 to 12 detected values sent from the center thermistor 41 (S4-1). The control unit 61 determines whether or not the mean value $T_1$ is higher than a center target temperature $T_{TAG}$, which serves as a temperature target value (S4-2). When the mean value $T_1$ is higher than the center target temperature $T_{TAG}$ (Yes in S4-2), the halogen lamp of the heating roller 26 is turned off (S4-3). When the mean value $T_1$ is lower than the center target temperature $T_{TAG}$ (No in S4-2), the halogen lamp of the heating roller 26 is turned on (S4-4). Accordingly, the mean value $T_1$ moves closer to the center target temperature $T_{TAG}$.

Then, the control unit 61 determines whether or not the mean value $T_1$ is higher than a center limit temperature $T_A$, which serves as a first upper limit value (S5). When the mean value $T_1$ is lower than the center limit temperature $T_A$ (No in S5), the control unit 61 returns from S2 to processing for transmitting a temperature detection request signal to the center thermistor 41 every predetermined time. When the mean value $T_1$ is higher than the center limit value $T_A$ (Yes in S5), a timer 62 shown in FIG. 2 starts counting operation (S6), and there is repeated processing pertaining to S2 to S4 for computing the mean value $T_1$ of the center temperature from a plurality of temperature values detected during the counting operation (S7). After lapse of $t_1$=200 msec since initiation of counting operation, a determination is made as to whether or not the mean value $T_1$ detected after initiation of the counting operation is always higher than the center limit temperature $T_A$ (S8). When the mean value $T_1$ detected since initiation of counting operation is lower, than the center limit temperature $T_A$ (No in S8) even once, the control unit 61 returns from $S_2$ to perform processing for transmitting a temperature detection request signal to the center thermistor 41 every predetermined time, and processing subsequent to $S_2$ is again repeated.

A temperature detection request signal is transmitted from the control unit 61 to the end thermistor 51 at a sampling cycle of 20 msec, as well (S2'), and the end thermistor 51 detects temperatures of the widthwise end portions of the heating roller 26 at every sampling cycle of 20 msec. The detected temperature value is sent to the control unit 61 (S3'). The control unit 61 computes a mean value $T_2$ for the end temperature from 10 to 12 detected values sent from the end thermistor 51 (S4') Next, the control unit 61 determines whether the sheet 3 to be fed to the fixing device 18 is the small size sheet 3*a* or the large size sheet 3*b*, by the sheet size detection sensor 33 shown in FIG. 2 (S5'). When the sheet 3 fed to the fixing device 18 is determined to be the large size sheet 3*b* (No in S5'), a determination is made as to whether or not the mean value $T_2$ is higher than an end limit temperature $T_{B1}$ serving as the second upper limit value (S6'). When the sheet 3 fed to the fixing device 18 is determined to be the small size sheet 3*a* (Yes in S5'), a determination is made as to whether or not the mean value $T_2$ is higher than an end limit temperature $T_{B2}$ serving as the second upper limit value (S7'). When the mean value $T_2$ is lower than the end limit temperature $T_{B1}$ (No in S6'), or when the mean value $T_2$ is lower than the end limit temperature $T_{B2}$ (No in S7'), the control unit 61 returns to processing, which starts from S2', for transmitting the temperature detection request signal to the end thermistor 51 every predetermined time. When the mean value $T_2$ is higher than the end limit temperature $T_{B1}$ (Yes in S6') or when the mean value $T_2$ is higher than the end limit temperature $T_{B2}$ (Yes in S7'), the timer 62 starts counting (S8'). During counting operation, processing pertaining to S2' to S4' for computing the mean value $T_2$ of end temperatures from a plurality of detected temperature values is repeated (S9'). After elapse of $t_2$=200 msec. since initiation of counting operation, a determination is made as to whether or not the mean value $T_2$ detected since the initiation of the counting operation is always higher than the end limit temperature $T_{B1}$ or $T_{B2}$ (S10'). When the mean value $T_2$ detected since initiation of counting operation has once become lower than the end limit temperature $T_{B1}$ or $T_{B2}$ (No in S10') once, the control unit 61 returns to processing in S2' for transmitting the temperature detection request signal to the end thermistor 51 at every predetermined time, and processing subsequent to S2' is repeated.

When the mean value $T_1$ of the center temperature detected since initiation of counting operation is always higher than the center limit temperature $T_A$ (Yes in S8), or when the mean value $T_2$ of the end temperature detected since initiation of the counting operation is always higher than the end limit temperature $T_{B1}$ or $T_{B2}$ (Yes in S10'), the control unit 61 determines the temperature of the halogen lamp A to be anomalous, and the halogen lamp A is turned off (S11). When the halogen lamp is turned off, an error due to the anomaly in the fixing temperature is informed to the user by an unillustrated liquid crystal panel or an unillustrated alarm of the laser printer 1 (S12), and processing is terminated.

On the assumption that a fixing disabled temperature, at which the heating roller 26 or the fixing device 18 is subjected to damage or breakdown for reasons of excessive heating of the halogen lamp A, is taken as T, a magnitude relationship of $T>T_{B2}>T_{B1}>T_A$ exists among the center limit temperature $T_A$; the end limit temperature $T_{B1}$ achieved when the large size sheet 3*b* passes the fixing device; and the end limit temperature $T_{B2}$ achieved when the small size sheet 3*a* passes through the fixing device.

Such a relationship of magnitude is set for two reasons; namely, a structural difference between the center thermistor 41 and the end thermistor 51 and the size of the sheet 3 fed to the fixing device 18.

As mentioned previously, the first reason is that the center thermistor 41 is disposed on, in a contacting manner, the surface area of the heating roller 26 where the image forming areas Wa and Wb of the sheet 3 pass. Accordingly, in order to prevent deterioration of temperature detection performance of the thermistor element 48 for detecting the temperature of the center thermistor 41, which would otherwise be caused when toner adheres to the thermistor element 48, and to make the thermistor element 48 resistant to abrasion due to slidable contact with the surface of the heating roller 26, the thermistor element 48 is coated with the leading end portion 46*a* of the metal plate 46 having a thickness of about 0.5 mm. In the meantime, the end thermistor 51 is disposed on, in a contacting manner, the surface area of the heating roller 26 where the non-image formation area of the sheet 3*b* of the largest size passes; namely, the surface area of the heating roller 26 where the image forming areas Wa and Wb do not pass. Hence, there is no worry about adhesion of toner to the thermistor element 58 that detects the temperature of the end thermistor 51, and the thermistor element 58 is coated with the resin tape 60, which has a thickness of about 0.1 mm and exhibits high thermal conductivity (see FIGS. 4 and 6). Consequently, since the center thermistor 41 is protected by the leading end section 46*b* of the metal plate 46 having a thickness of about 0.5 mm, the time during which heat propagates from the heating roller 26 to the thermistor element 48 is long; namely, the reaction speed of the thermistor element 48 is slower than the reaction speed of the thermistor element 58 of the end thermistor 51. When the center limit temperature $T_A$ is made equal to the end limit temperatures $T_{B1}$ and $T_{B2}$, the actual temperature has risen in excess of the temperatures $T_{B1}$ and $T_{B2}$ when the center thermistor 41 detects the temperatures $T_{B1}$ and $T_{B2}$, which may lead to the possibility of the temperature reaching a fixing disabled temperature T. For this reason, the temperatures are set as $$T_{B1}, T_{B2}>T_A.$$

The second reason is as follows. When the small size sheet 3*a* is being thermally fixed, the area on the surface of the heating roller 26 whose heat is drawn by the sheet 3*a* is small. Particularly, the surface temperatures of both ends of the heating roller 26, which do not contact the sheet 3*a* at all, have become more likely to increase than when the large size sheet 3*b* having a width extending to the neighborhood of both ends of the heating roller 26 is thermally fixed. Therefore, if the end limit temperature $T_{B2}$ acquired when the small size sheet 3*a* passes is made equal to the end limit temperature $T_{B1}$ acquired when the large size sheet 3*b* passes, the temperature value detected from the axial end of the heating roller 26 by the end thermistor 51 will immediately reach the end limit temperature, so that the temperature of the heating roller 26 may be immediately determined to be anomalous. For this reason, the end limit temperature $T_{B2}$ achieved when the small size sheet 3*a* passes is made higher than the end limit temperature $T_{B1}$ achieved when the large size sheet 3*b* passes, to thus achieve a relationship of $T_{B2}>T_{B1}$.

A sheet (having a width of 148 mm), which has a length of A5-size and a width of A6-size, is adopted as the small size sheet 3*a*. Further, a sheet (having a width of 209 mm), which has a length of A4-size, is adopted as the large size sheet 3*b*.

Second Aspect

A laser printer serving as a fixing device and an image forming apparatus, both of which pertain to a second aspect of the present invention, will now be described. Constituent elements corresponding to those of the first aspect are assigned the same reference numerals, and explanations of elements overlapping those of the first aspect are omitted for brevity.

In the first aspect, the center limit temperature $T_A$ is set so as to become lower than the end limit temperatures $T_{B1}$, $T_{B2}$. Even when a difference exists between the reaction speed of the center thermistor 41 and that of the end thermistor 51, an anomaly in the temperature of the halogen lamp A can be accurately determined. However, in the present aspect, a sampling cycle $t_c$ used as a cycle, at which the center thermistor 41 detects the temperature of the axial center surface of the heating roller 26, is set so as to become shorter than the sampling cycle $t_e$=20 msec, at which the end thermistor 51 detects the temperature of the axial end surface of the heating roller 26, namely, $t_c$=10 msec, rather than the center limit temperature $T_A$ being set so as to become lower than the end limit temperatures $T_{B1}$, $T_{B2}$.

The control unit 61 compares the mean values $T_1$ and $T_2$, which are obtained by averaging a plurality of temperature values detected by the two thermistors 41, 51, with the center limit value $T_A$ and the end limit values $T_{B1}$, $T_{B2}$, to thus determine occurrence of an anomaly in the temperature of the halogen lamp A. So long as the sampling cycle $t_c$, at which the center thermistor 41 detects a temperature, is set so as to become shorter than the sample cycle $t_e$, at which the end thermistor 51 detects a temperature by an amount corresponding to a delay of the reaction speed of the center thermistor 41 behind the reaction speed of the end thermistor 51, the control unit 61 can compute the mean temperature values $T_1$ and $T_2$ at essentially the same speed. If the control unit 61 performs control operation shown in FIG. 7, an anomaly can be accurately detected without setting the center limit temperature $T_A$ so as to become lower than the end limit temperatures $T_{B1}$, $T_{B2}$.

Other Aspects

Although the present invention has been described on the basis of the aspect, the present invention is not limited to the aspect. The present invention can be subjected to various modifications within the scope of technical idea of the present invention.

Figure 8:
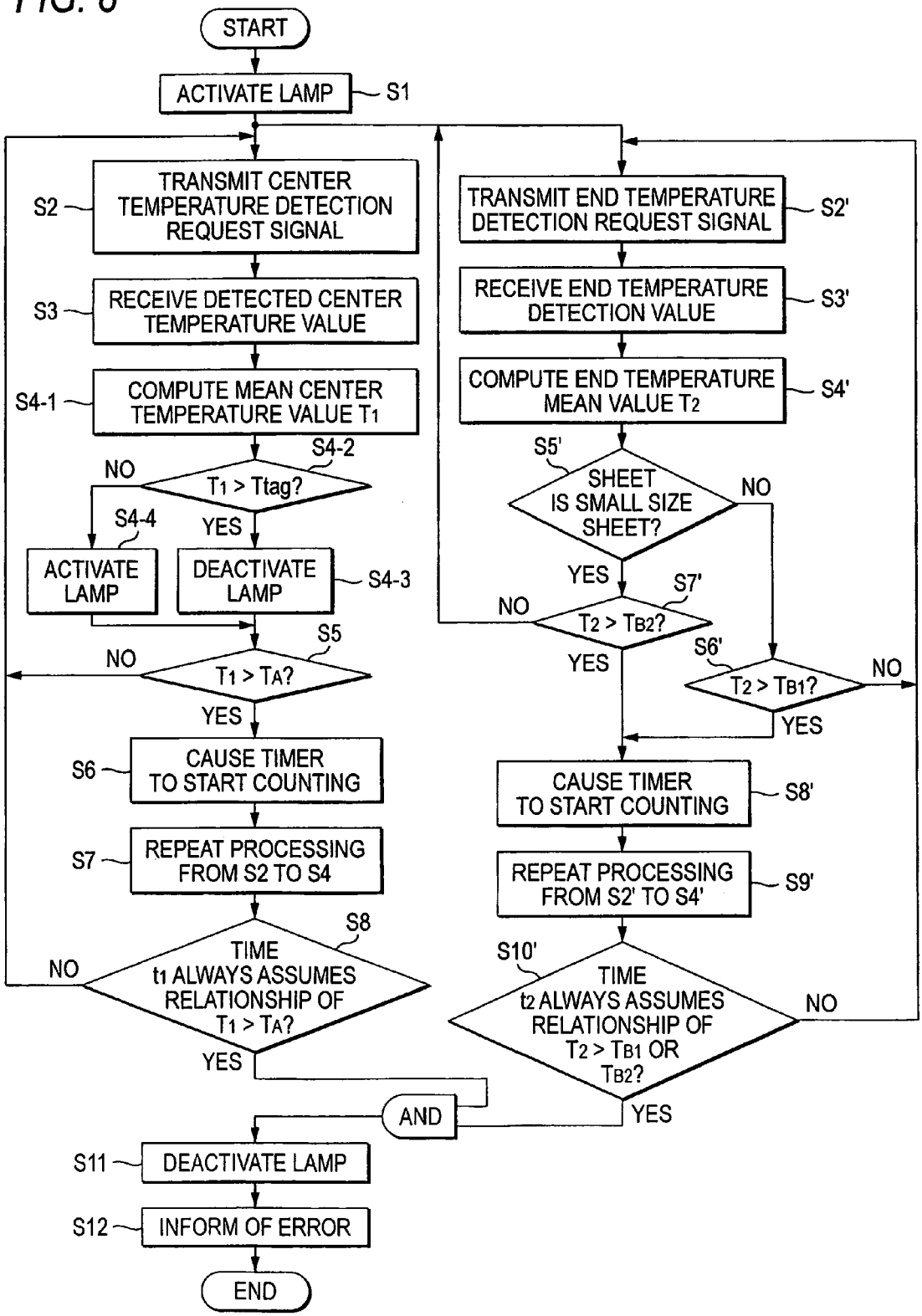
FIG. 8 is a flowchart showing control operation of the control unit 61 employed when an anomaly in the temperature of a halogen lamp A of the heating roller 26 according to the modification is detected.
Figure 9:
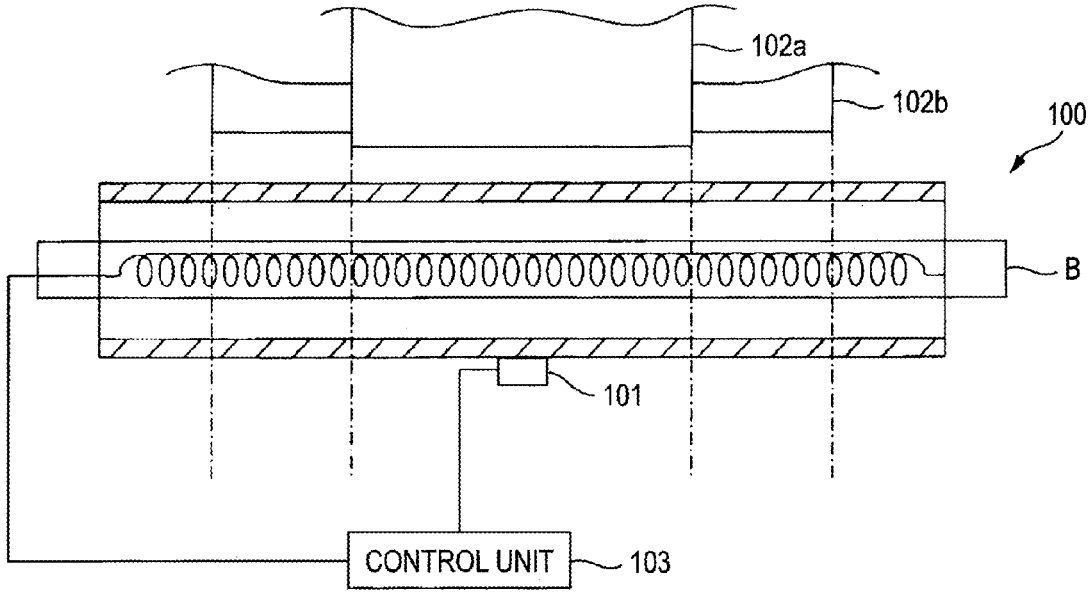
FIG. 9 (Prior Art)
FIG. 9 is a front cross sectional view showing the configuration of a conventional art configuration for detecting the temperature of a heating roller.

As shown in FIG. 7, in the present aspect, if at least one of the center temperature $T_1$ and the end temperature $T_2$ has exceeded the center limit temperature $T_A$ or the end limit temperatures $T_{B1}$, $T_{B2}$ for a given period of time, the control unit 61 determines an anomaly, to thus deactivate the halogen lamp A. However, as indicated by the flowchart shown in FIG. 8, an AND condition of S8 and S10' is determined. When the center temperature $T_1$ has exceeded the center limit temperature $T_A$ for a given period of time and when the end temperature $T_2$ has exceeded the end limit temperature $T_{B1}$ or $T_{B2}$ for a given period of time, the control unit 61 may determine occurrence of an anomaly, to thereby deactivate the halogen lamp A. By this configuration, the laser printer 1 is used in the environment where noise is likely to arise in the anomaly detection circuit, consisting of the control unit 61 and the thermistors 41, 51, and the mean value $T_1$ of the center temperature and the mean value $T_2$ of the end temperature become unreliable due to occurrence of great variations in detected temperature values. In such a situation, an anomaly can be detected more accurately, so long as the halogen lamp A is deactivated when the temperatures detected by the two temperature detection units have exceeded the upper limit value.

Settings of the sampling cycle $t_c$ at which the center thermistor 41 detects a temperature and those of the sampling cycle $t_e$ at which the end thermistor 51 detects a temperature may be changed according to the heat capacity of the heating roller 26. For instance, the heat capacity becomes smaller as the diameter of the heating roller 24 becomes smaller, so that the temperature is likely to increase. Hence, variations in a plurality of detected temperatures used for computing the mean values $T_1$, $T_2$ can be reduced by shortening the sampling cycles $t_c$, $t_e$.

According to the aspects, the temperature of the end portions of the heating roller is more easily increased when a supplied recording medium is of narrow width than when a supplied recording medium is of wide width. However, by setting the second upper limit high, a control unit can be prevented from stopping heating of the heating unit despite absence of an anomaly.

According to the aspects, the control unit determines whether or not the temperatures detected several times by the two temperature detection units has exceeded the upper limit value. Accordingly, when great variations exist in the temperatures detected in an environment where noise is likely to arise in an anomaly detection circuit, heating operation is stopped when values detected by the two temperature detection units have exceeded the upper limit value, so that an anomaly can be accurately detected.

According to the aspects, the image forming apparatus is equipped with the fixing device that accurately determines an anomaly. Hence, safety can be afforded to the user who uses the image forming apparatus.

What is claimed is:

1. A fixing device comprising:

a fixing roller that is heated by a heating unit to fix a developer image on a supplied recording medium;

a center temperature detection unit including a protective member that protects the center temperature detection unit, the center temperature detection unit contacts the fixing roller in an axial center of the fixing roller and detects a temperature of the center section;

an end temperature detection unit that contacts the fixing roller at an end portion of the fixing roller outside of a maximum print area of the recording medium and detects a temperature of the end section; and a control unit that controls heating of the fixing roller performed by the heating unit so that the heating is stopped when the value detected by the center temperature detection unit has exceeded a first upper limit value, and the heating is stopped when the value detected by the end temperature detection unit has exceeded a second upper limit value, the first upper limit value being lower than the second upper limit value.

2. The fixing device according to claim 1, wherein the second upper limit value is set higher when the supplied recording medium is of smaller width than when the supplied recording medium is of greater width.

3. The fixing device according to claim 1, wherein when a value detected by the center temperature detection unit has exceeded the first upper limit value and when a value detected by the end temperature detection unit has exceeded the second upper limit value, the control unit stops heating of the fixing roller performed by the heating unit.

4. The fixing device according to claim 2, wherein when a value detected by the center temperature detection unit has exceeded the first upper limit value and when a value detected by the end temperature detection unit has exceeded the second upper limit value, the control unit stops heating of the fixing roller performed by the heating unit.

5. The fixing device according to claim 1, wherein the heating unit is a halogen lamp.

6. The fixing device according to claim 1, wherein the protective member is a metal plate.

7. The fixing device according to claim 6, wherein the metal plate is a copper plate.

8. A fixing device comprising:

a fixing roller that is heated by a heating unit to fix a developer image on a supplied recording medium;

a center temperature detection unit including a protective member that protects the center temperature detection unit, the center temperature detection unit contacts the fixing roller in an axial center of the fixing roller and detects a temperature of the center section;

an end temperature detection unit that contacts the fixing roller at an end portion of the fixing roller outside of a maximum print area of the recording medium and detects a temperature of the end section; and a control unit that controls heating of the fixing roller performed by the heating unit so that the heating is stopped when the value detected by the center temperature detection unit has exceeded a first upper limit value, and the heating is stopped when the value detected by the end temperature detection unit has exceeded a second upper limit value, wherein a cycle at that the center temperature detection unit detects the temperature of the center section is set so as to become shorter than a cycle at which the end temperature detection unit detects the temperature of the end portion.

9. The fixing device according to claim 8, wherein the second upper limit value is set higher when the supplied recording medium is of smaller width than when the supplied recording medium is of greater width.

10. The fixing device according to claim 8, wherein when a value detected by the center temperature detection unit has exceeded the first upper limit value and when a value detected by the end temperature detection unit has exceeded the second upper limit value, the control unit stops heating of the fixing roller performed by the heating unit.

11. The fixing device according to claim 9, wherein when a value detected by the center temperature detection unit has exceeded the first upper limit value and when a value detected by the end temperature detection unit has exceeded the second upper limit value, the control unit stops heating of the fixing roller performed by the heating unit.

12. The fixing device according to claim 8, wherein the heating unit is a halogen lamp.

13. The fixing device according to claim 8, wherein the protective member is a metal plate.

14. The fixing device according to claim 13, wherein the metal plate is a copper plate.

15. An image forming apparatus comprising:

an image forming unit that transferees a developer image; and a fixing device including:

a fixing roller that is heated by a heating unit to fix the developer image on a supplied recording medium;

a center temperature detection unit including a protective member that protects the center temperature detection unit, the center temperature detection unit contacts the fixing roller in an axial center of the fixing roller and detects a temperature of the center section;

an end temperature detection unit that contacts the fixing roller at an end portion of the fixing roller outside of a maximum print area of the recording medium and detects a temperature of the end section; and a control unit that controls heating of the fixing roller performed by the heating unit so that the heating is stopped when the value detected by the center temperature detection unit has exceeded a first upper limit value, and the heating is stopped when the value detected by the end temperature detection unit has exceeded a second upper limit value, the first upper limit value being lower than the second upper limit value.

16. An image forming apparatus comprising:

an image forming unit that transferees a developer image; and a fixing device including:

a fixing roller that is heated by a heating unit to fix the developer image on a supplied recording medium;

a center temperature detection unit including a protective member that protects the center temperature detection unit, the center temperature detection unit contacts the fixing roller in an axial center of the fixing roller and detects a temperature of the center section;

an end temperature detection unit that contacts the fixing roller at an end portion of the fixing roller outside of a maximum print area of the recording medium and detects a temperature of the end section; and a control unit that controls heating of the fixing roller performed by the heating unit so that the heating is stopped when the value detected by the center temperature detection unit has exceeded a first upper limit value, and the heating is stopped when the value detected by the end temperature detection unit has exceeded a second upper limit value, wherein a cycle at that the center temperature detection unit detects the temperature of the center section is set so as to become shorter than a cycle at which the end temperature detection unit detects the temperature of the end portion.

* * * * *